US006047656A

United States Patent [19]

McKinley et al.

[11] Patent Number: 6,047,656

[45] Date of Patent: Apr. 11, 2000

[54] RETRACTABLE FRONT RUDDERS

[75] Inventors: John A. McKinley, Melbourne; Elmer Zebley, Orlando, both of Fla.

[73] Assignee: Fudders, Inc., Melbourne, Fla.

[21] Appl. No.: 09/037,407

[22] Filed: Mar. 10, 1998

[51] Int. Cl.[7] ..... B63H 25/06

[52] U.S. Cl. ..... 114/163; 114/145 R; 114/347

[58] Field of Search ..... 114/343, 347, 114/162, 144 R, 163, 145 R

[56] References Cited

U.S. PATENT DOCUMENTS

| | | | |
|---|---|---|---|
| D. 202,391 | 9/1965 | Eschmann | D71/1 |
| D. 299,021 | 12/1988 | Hand | D12/317 |
| 1,911,192 | 5/1933 | Harvey . | |
| 3,922,988 | 12/1975 | Caton | 114/165 |
| 3,941,072 | 3/1976 | Caton | 114/165 |
| 4,387,661 | 6/1983 | Duff | 114/145 R |
| 4,556,006 | 12/1985 | Kaupat | 114/162 |
| 4,589,365 | 5/1986 | Masters | 114/347 |
| 4,641,594 | 2/1987 | Birkett | 114/43 |
| 4,862,818 | 9/1989 | Sullivan | 114/126 |
| 4,949,662 | 8/1990 | Kobayashi | 114/162 |
| 4,979,916 | 12/1990 | Leblanc | 440/27 |
| 5,460,551 | 10/1995 | Beres | 440/27 |
| 5,507,244 | 4/1996 | Lee | 144/345 |
| 5,672,080 | 9/1997 | Gauthier | 440/27 |

*Primary Examiner*—Stephen Avila

*Attorney, Agent, or Firm*—Brian S. Steinberger; Law Offices of Brian S. Steinberger

[57] ABSTRACT

Retract front rudders to be used as a steering system for small water craft such as canoes and kayaks. The system has a pair of angled retractable rudders mounted in a forward/bow portion and attached by shafted cables to a pair of movable control footpegs mounted in the rear or stern of the craft. The system can be mounted through an opening in the front floor of the craft. Alternatively, the system can be attached to the exterior front of the forward section of the craft.

18 Claims, 8 Drawing Sheets

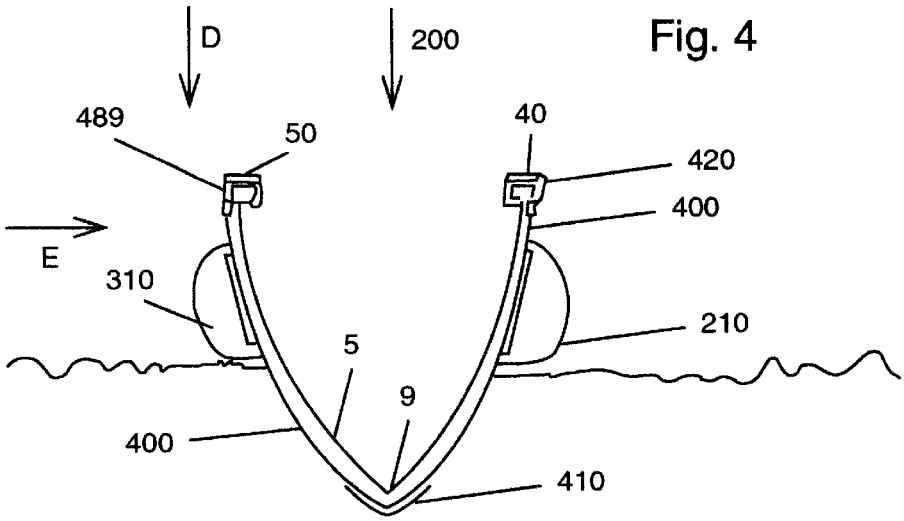
Fig. 4
Fig. 5A
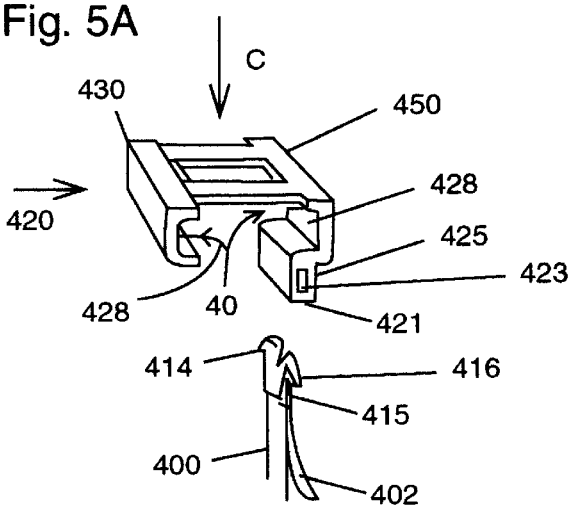
Fig. 6
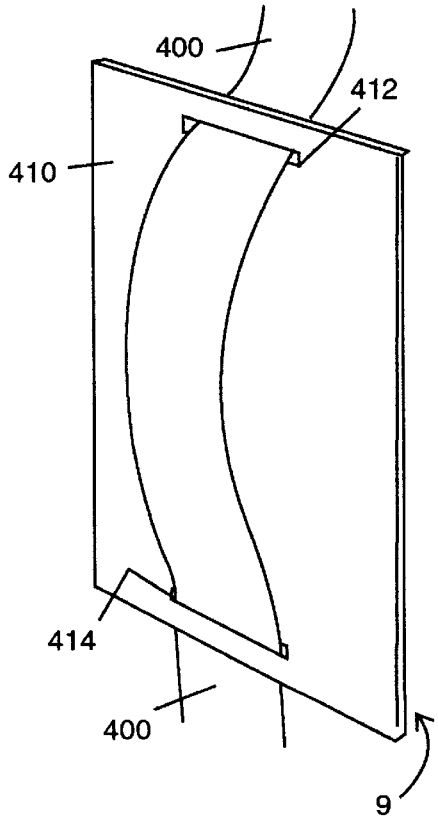
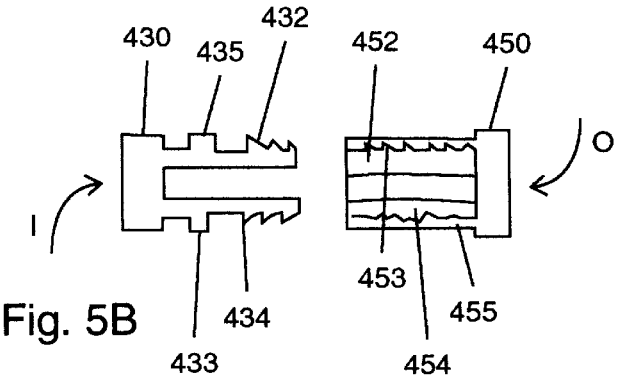
Fig. 5B

RETRACTABLE FRONT RUDDERS

This invention relates to canoes and kayaks, and in particular to a steering system for manual paddle powered watercraft having a pair of angled retractable rudders mounted in a forward/bow portion and attached by shafted cables to a pair of movable control footpegs mounted in the rear or stern of the craft.

BACKGROUND AND PRIOR ART

Controlling the path of small crafts such as canoes and kayaks, is a complex and subtle art. The forward thrust applied by the manually moving paddle is off the midline (longitudinal axis) of the craft and thereby creates a lateral displacement to the craft itself. The user can correct for the lateral displacement by switching the paddles from side-to-side as well as using the paddle itself as a rear rudder. Although these corrective measures are possible, they still require proper study and many hours to perfect. Mechanical systems have been proposed that include rear positioned rudders that can flip up and bypass obstructions and obstacles underneath the water surface thereby preventing damage to the rudders. See for example: U.S. Pat. Nos. Des. 202,391 to Eschmann; 2,528,608 to Rickart et al.; 2,991,749 to Patterson; 3,085,540 to Crabille; 3,147,730 to Specht; 3,941,072 to Caton et al; and 5,507,244 to Lee. However, these patents are generally directed to rear based fastened rudders, some of which are part of additional motor mounts, and require the user to relinquish one of their hands to operate the rudder. U.S. Pat. No. 3,922,988 to Caton et al. mentions foot operation. But even this patent requires rearwardly mounted rudders for small craft. U.S. Pat. Nos. 4,949,662 to Kobayashi and 5,672,080 to Gauthier each describe single rudders in the front. However, these patents are directed to single rudders that connect to hand operated steering wheel controls on a jet ski type boat and a "water bicycle", which are substantially different than canoes and kayaks. U.S. Pat. Nos. 4,979,916 to LeBlanc and 5,460,551 to Beres describe foot operated paddles for small craft. However, these references eliminate the use of hand operated paddles and still do not have front based controllable rudders. U.S. Pat. Nos. 4,641,594 to Birkett and 4,862,818 to Sullivan describe canoe steering attachments for the front of canoes. However, each of these references have fixed latched attachments for the front outer sides of canoes and have no controls for operating these fixed attachments.

SUMMARY OF THE INVENTION

The first objective of the present invention is to provide a steering system for paddle powered watercrafts that does not impart substantial changes to the handling and glide of the craft.

The second object of this invention is to provide a steering system for paddle powered watercrafts that only has to be controlled by the user's feet.

The third object of this invention is to provide a steering system for paddle powered watercrafts that places controllable rudders forward to the center of gravity of the craft.

The fourth object of this invention is to provide a steering system for paddle powered watercrafts that is strong and lightweight.

The fifth object of this invention is to provide a steering system for paddle powered watercrafts that is safe and easily workable by the user.

The sixth object of this invention is to provide a steering system for paddle powered watercrafts having variable degrees of lateral thrust allowing for both gradual and sharp turns.

The seventh object of this invention is to provide a steering system for paddle powered watercrafts that can be mounted with minor changes to the physical characteristics of the craft.

The eighth object of this invention is to provide a steering system for paddle powered watercrafts that causes minimal changes to performance characteristics of the craft.

A preferred embodiment of the invention includes the combination of a water craft such as a canoe and kayak propelled by hand manipulated paddles having a bow and stern, dual angled rudders adjacent to the bow of the craft, and foot peddles for controlling the raising and lowering of the cable connected and spring biassed rudders, wherein the user depressing each of the foot peddle raises and lowers a rudder to change direction of the craft. A first embodiment mounts the rudders through a floor portion adjacent to the bow of the craft, with the bow section being foam filled for keeping the bow buoyant and afloat. A bulk head positioned between the first rudder and the stern of the craft seals the rudders and floor-through-holes from the rest of the water craft. A second embodiment has the rudders individually in housings connected to straps for being mounted external to the front bow section of the water craft. The straps are connected to side clamps attached to gunwales on the water craft, with a flexible plate for protecting the strap from a bottom of the water craft.

Further objects and advantages of this invention will be apparent from the following detailed description of a presently preferred embodiment which is illustrated schematically in the accompanying drawings.

BRIEF DESCRIPTION OF THE FIGURES.

FIG. 4 is a front view of a second preferred embodiment of the novel steering system invention used as an attachment to a small water craft.

FIG. 5A is a perspective view of the gunwale clamp and strap attachment for use with the second embodiment.

FIG. 5B is a top exploed view of the gunwale clamp of FIG. 5A along arrow C.

FIG. 6 is an enlarged view of the strap connector used in the embodiment of FIG. 4.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
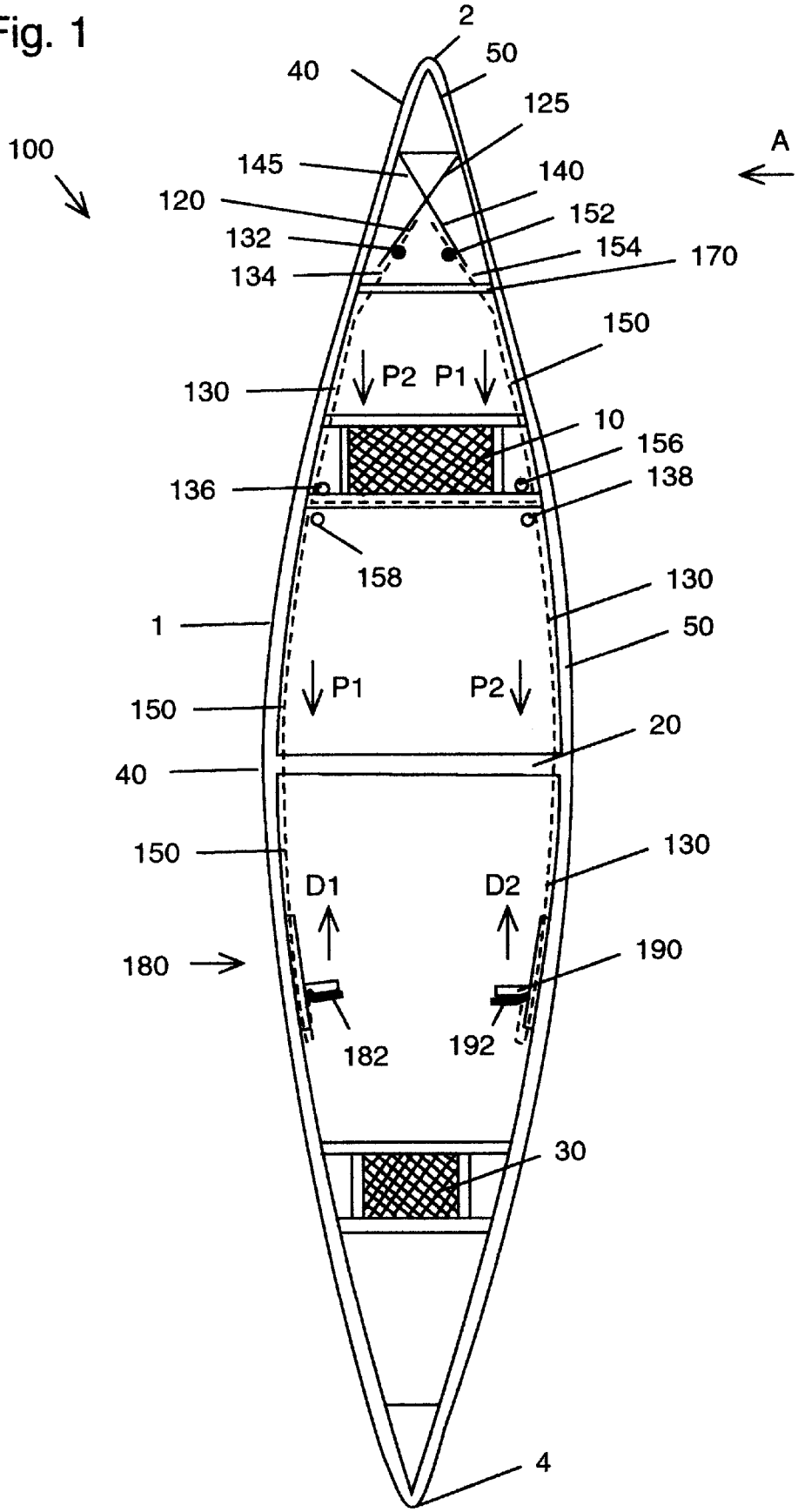
FIG. 1 is a top view of a first preferred embodiment of the novel steering system invention used inside a small water craft.
Figure 2:
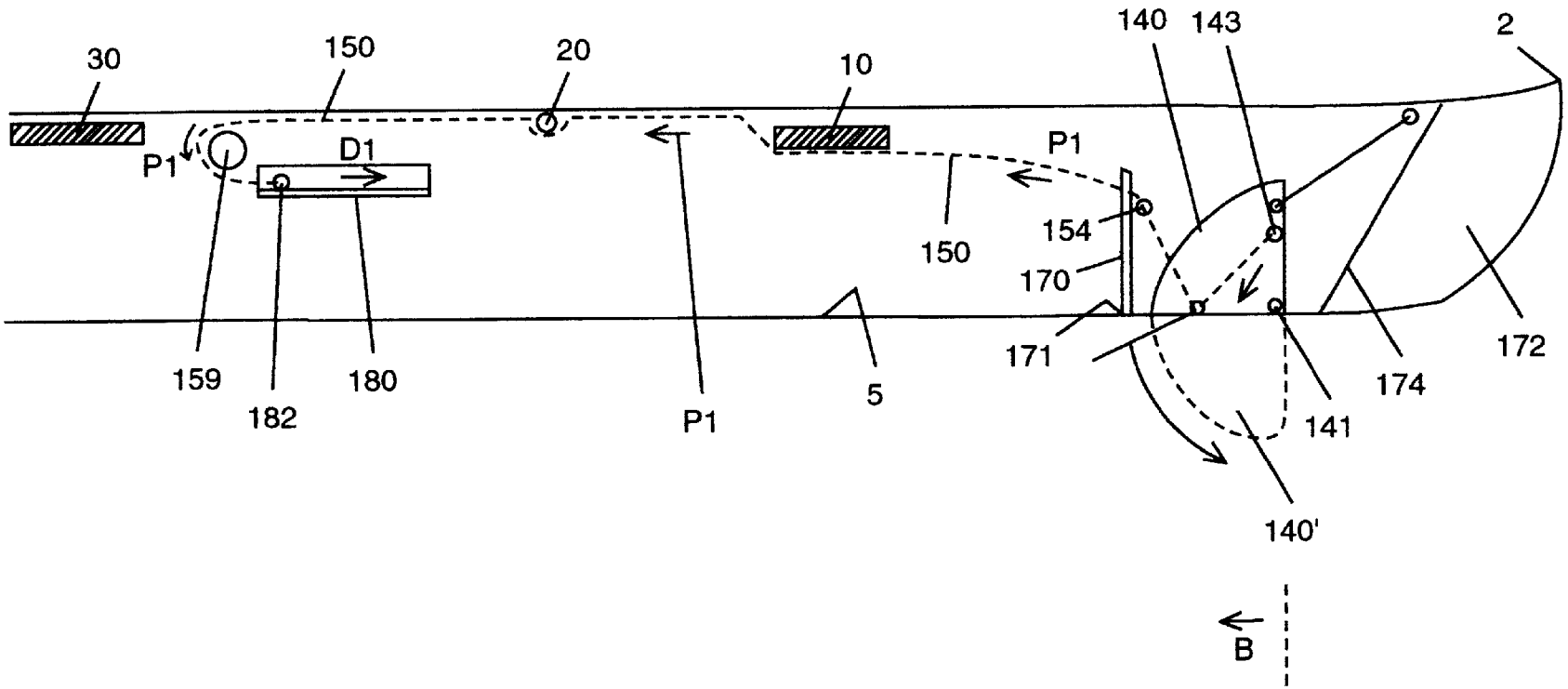
FIG. 2 is an enlarged side cross-sectional view of the invention in the water craft of FIG. 1 along arrow A.
Figure 3:
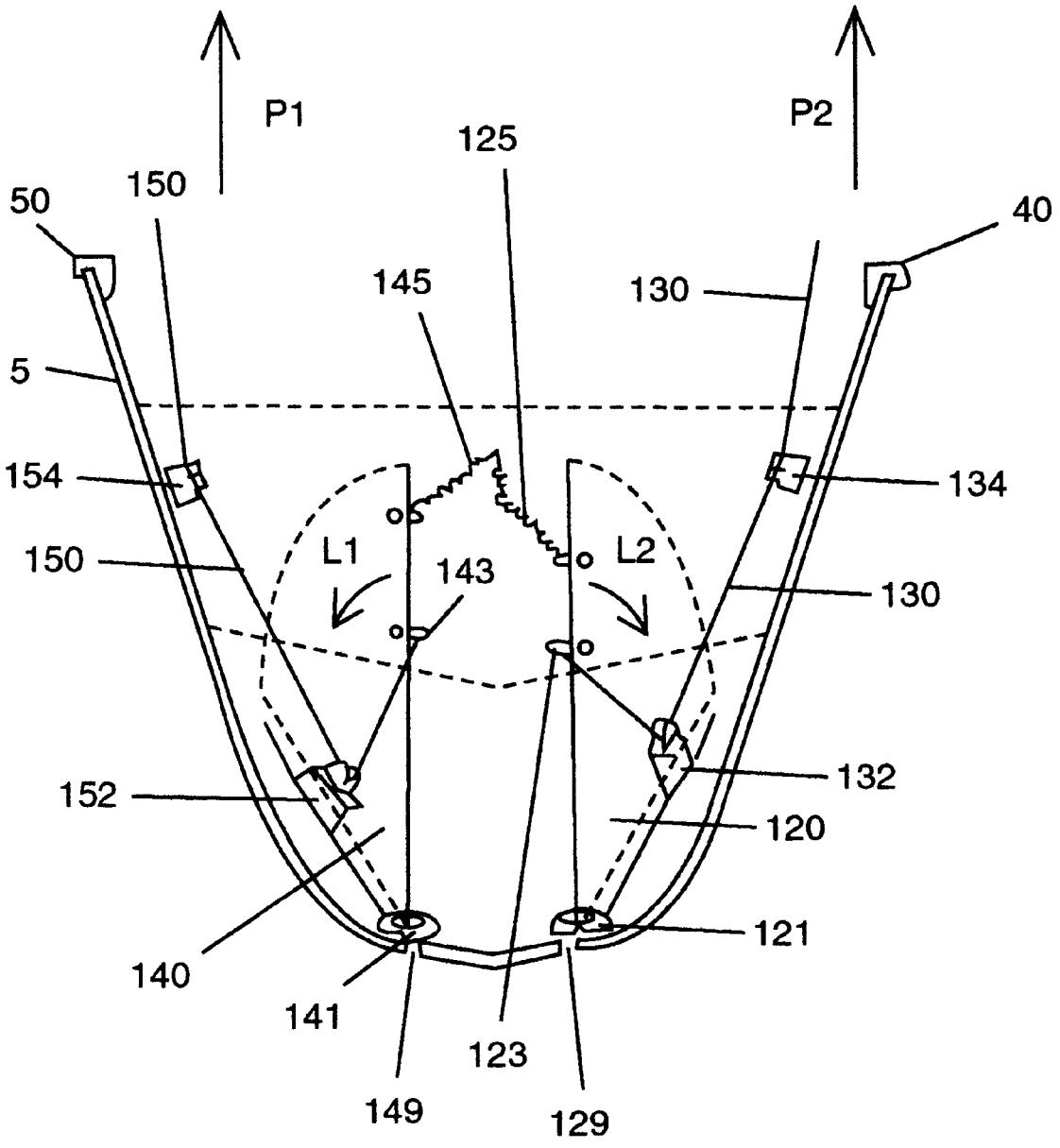
FIG. 3 is a cross-sectional front view of the water craft of FIG. 2 along arrow B.

FIG. 1 is a top view of a first preferred embodiment 100 of the novel steering system invention used inside a small water craft 1. FIG. 2 is an enlarged side cross-sectional view of the first preferred embodiment 100 in the water craft 1 of FIG. 1 along arrow A. FIG. 3 is a cross-sectional front view of the water craft of FIG. 2 along arrow B. Referring to FIGS. 1–3, the first preferred embodiment 100 is used with a small water craft 1, such as but not limited to a canoe, kayak and the like, front bow tip end 2, front bow seat 10, center thwart 20, rear stern seat 30 and stern tip end 4. The operation of both rudders 120 and 140 will now be described.

Referring to FIGS. 1–3, embodiment 100 includes a left rudder 140 pivotally mounted by a hull attached pivot pin 141 at a front end of hull 5, where an inwardly spring biassed left elastomeric cord 145 connects the left rudder 140 to bulkhead 170. An attachment screw 143 attaches one end of cable 150 which passes through a left hull mounted pulley 152 to a front left bulkhead mounted cable guide 154. Cable 150 passes along the inside walls of gunwale 50 to a mid-right-pulley 156 behind front seat 10 which causes the cable 150 to pass across to the opposite side of craft 1 and into another pulley 158, which passes the cable 150 around another pulley assembly 159 to left foot-peg assembly 180 which has a spring biassed depressible foot peddle 182. The left foot-peg assembly 180 and peddle 182 are shown and described in greater detail in reference to FIGS. 10–11.

Referring to FIGS. 1–3, a user(not shown) sitting or kneeling adjacent to rear seat 30, depresses foot peddle 182 in the direction of arrow D1, pulls cable 150 in the direction of arrow P1, causing rudder 140 to pivot about pin 141 and rotate in an arc in the direction of arrow L1 so that rudder 140 passes through hull based longitudinal left narrow slot 149 to a lowered position 140' beneath the craft 1.

Similarly, embodiment 100 further includes a right rudder 120 pivotally mounted by a hull attached pivot pin 121 at a front end of hull 5, where an inwardly spring biassed right elastomeric cord 125 connects the right rudder 120 to bulkhead 170. An attachment screw 123 attaches one end of cable 130 which passes through a right hull mounted pulley 132 to a front right bulkhead mounted cable guide 134. Cable 130 passes along the inside walls of gunwale 40 to a mid-right-pulley 136 behind front seat 10 which causes the cable 130 to pass across to the opposite side of craft 1 and into another pulley 138, which passes the cable 130 to left foot-peg assembly 190 which has a spring biassed depressible foot peddle 192. The user sitting/kneeling on seat 30 depresses foot peddle 192 in the direction of arrow D2, pulls cable 130 in the direction of arrow P2, causing rudder 120 to pivot about pin 121 and rotate in an arc in the direction of arrow L2 so that rudder 120 passes through hull based longitudinal left narrow slot 129 to a lowered position beneath the craft 1. Note that left foot peddle 182 causes the right rudder 140 to be lowered and raised, while right foot peddle 192 causes the left rudder 120 to be lowered and raised.

Note that bulkhead 170 is a vertical wall sized slightly higher than rudders 120, 140 in their raised positions, with a bottom edge 171 sealingly separating the forward bow section 2 of the craft 1 from the rest of the back and stern section 4. On the other side of rudders 120, 140 is a front wall 174 housing a floating materials 172 such as foam and the like which keeps the bow section 2 buoyant and afloat even with the narrow through-hole slots 129, 149.

FIG. 4 is a front view of a second preferred embodiment 200 of the novel steering system invention used as an attachment to a small water craft 1 having right side rudder housing 210 and left side rudder housing 310 attached by strap 40 about the exterior of the hull 5 of the forward/bow section 2 of the craft, in a similar general position to the rudders described in the previous embodiment.

FIG. 5A is a perspective view of the left gunwale clamp 420 and strap attachment 400 for use with the second embodiment 200. FIG. 5B is a top exploded view of the gunwale clamp 420 of FIG. 5A along arrow C. Clamp 420 includes left member 430 having inwardly protruding parallel teeth members 432, 434 having inwardly depressible tabs 433, 435 which allow the members 432, 434 to pass and lock onto mateable interior notches 453 inside interior slots 453, 454 of right member 450. A downwardly extending socket 425 having a side-holes 423 allows for buckle edges 414, 416 of buckle 415 to attach and lock onto. Strap end 402 of strap 400 is fixed to buckle 415. Left member 430 is positioned on the inwale side of left side gunwale 40. Right gunwale clamp 480 is connected in similarly to left gunwale 50

FIG. 6 is an enlarged view of the strap connector 410 used in the embodiment of FIG. 4. Connector plate 410 can be a flexible planar plate formed of rubber, vinyl, soft plastic, and the like, having slots 412, 414 for allowing the strap 400 to pass there-through, so that the strap 400 itself does not abut and rub against the lowest bottom edge 9 of the hull 5 of craft 1.

Figure 7:
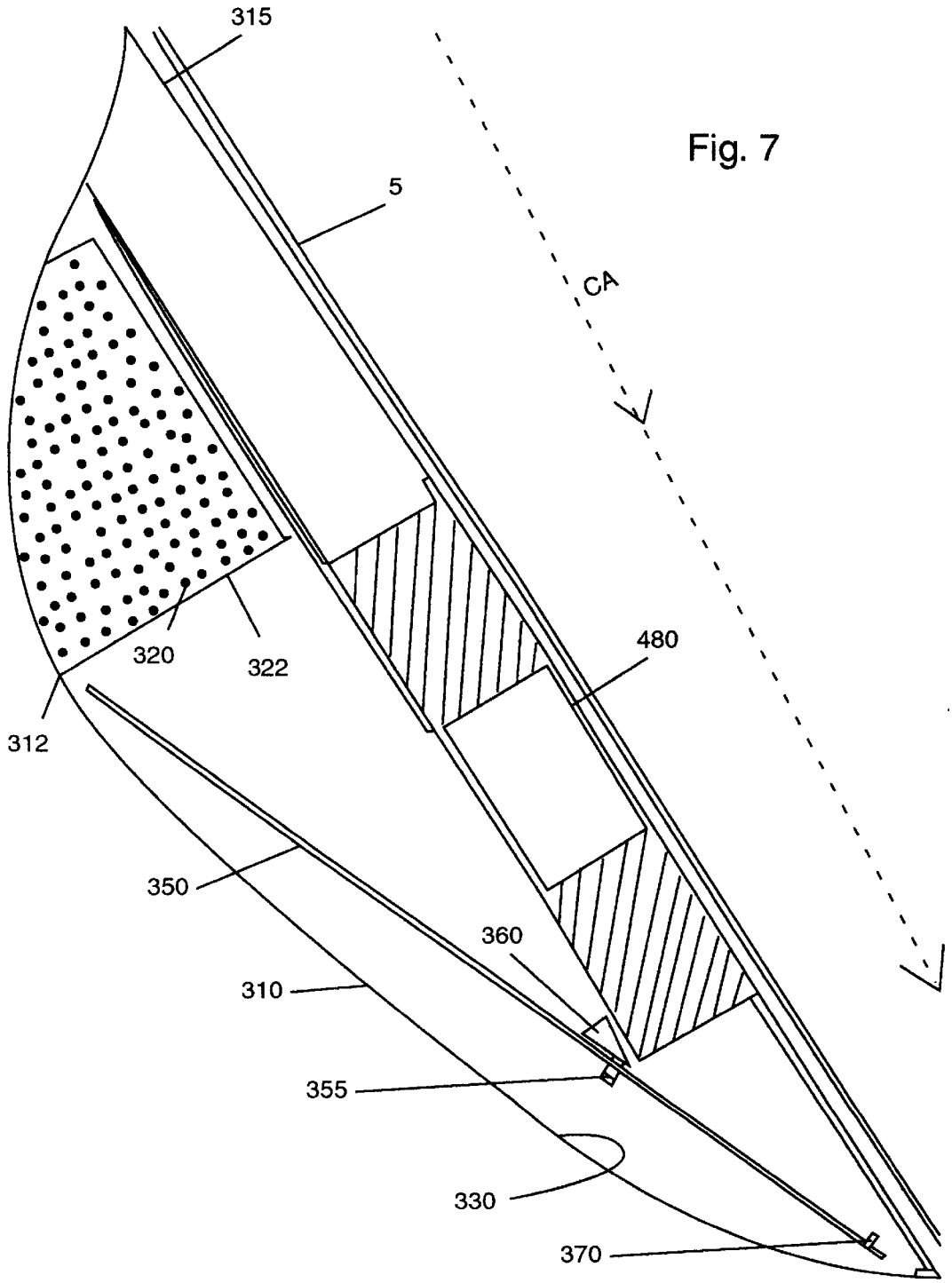
FIG. 7 is a top view of one rudder attachment used in the embodiment of FIG. 4 along arrow D.
Figure 8:
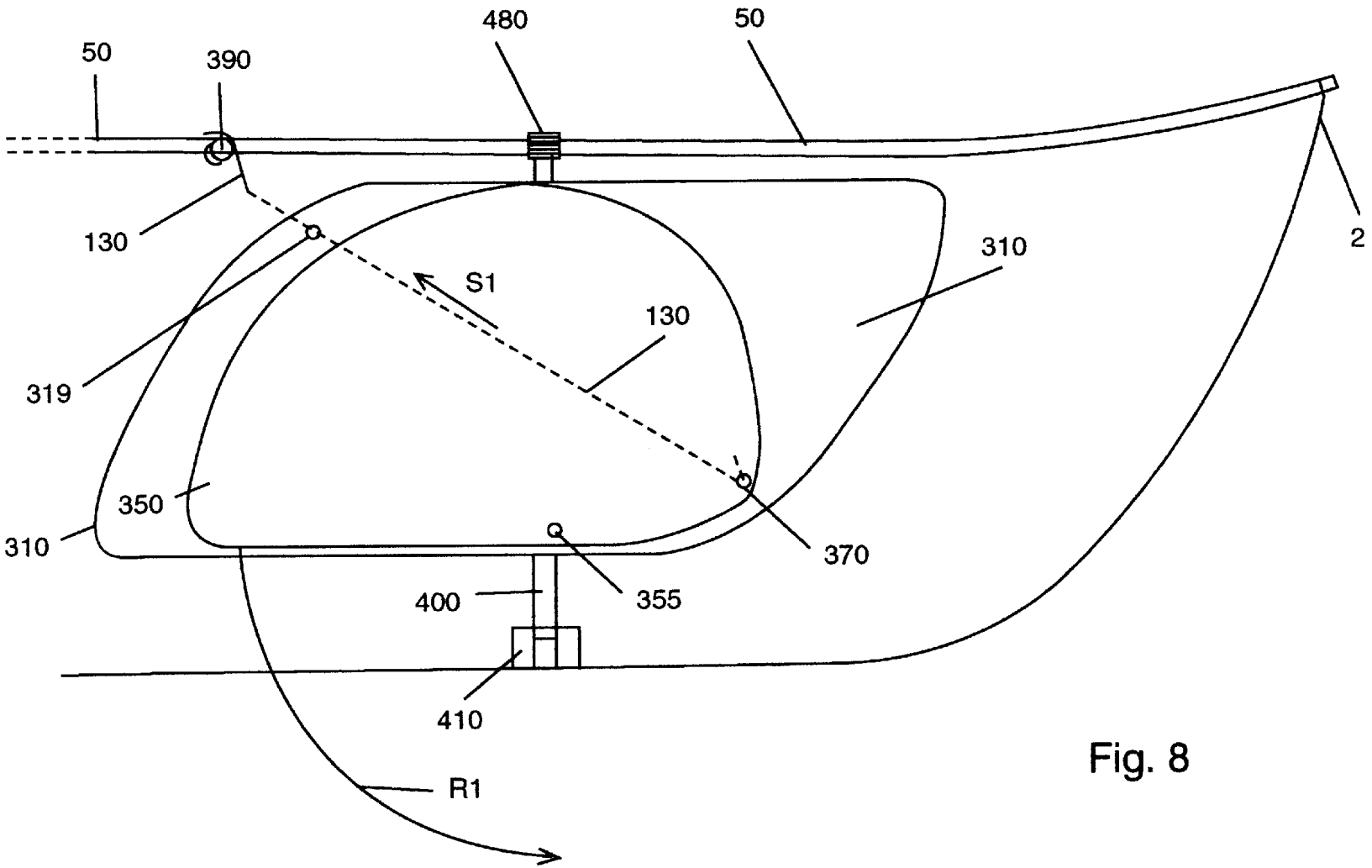
FIG. 8 is a side view of a side rudder attachment of FIG. 4 along arrow E.

FIG. 7 is a top view of one rudder attachment 310 used in the attachment embodiment 200 of FIG. 4 along arrow D. FIG. 8 is a side view of the side rudder attachment 310 of FIG. 4 along arrow E. Referring to FIGS. 7–8, side rudder attachment 310 has an outer curved shell 312 and a flat rear surface 315 which can conform to the side surface of hull 5, and a rear closed section 322 housing a flotation material 320 such as foam, and the like. The forward section 330 has a rudder 350 which pivots about a spring loaded hinge 360(shown and described in greater detail in reference to FIG. 9). An attachment screw 370 attaches one end of cable 130 which passes through a cable guide 319 and a hull mounted pulley 390 to the same interior components shown inside the water craft 1 of FIG. 1. The other rudder attachment 210 is mounted on the opposite side of the hull 5 with similar components and operation.

Figure 9:
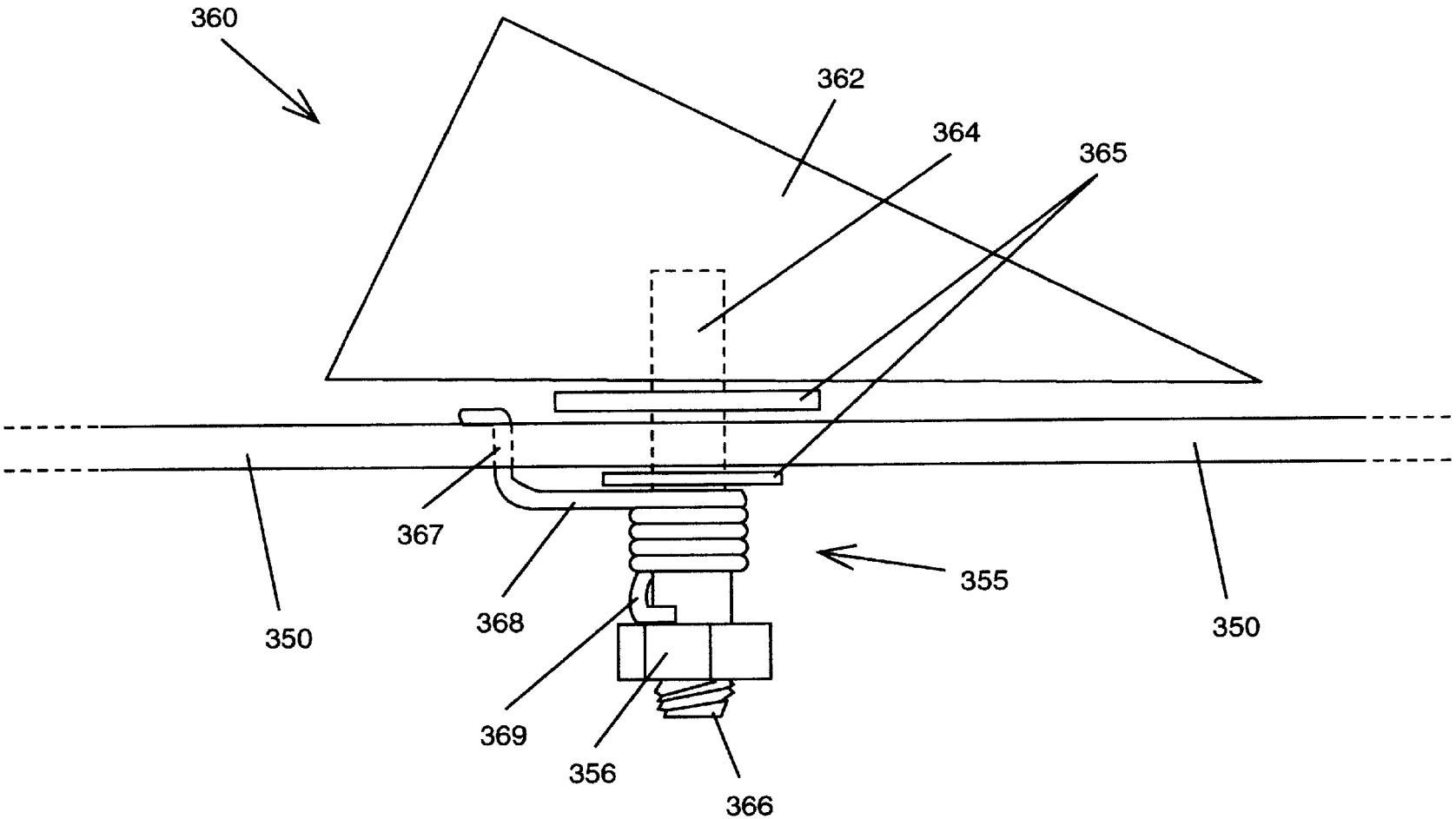
FIG. 9 is an enlarged view of the spring-mounted hinge of FIG. 7.

FIG. 9 is an enlarged view of the spring-mounted hinge 360 of FIG. 7. Spring-mounted hinge 360 includes a triangular mounting block 362 with a pivot shaft 364 extending from one side thereof with a threaded end 369 where a screwed on nut 356 holds a coiled spring 368 having ends 367 and 369 fixed into rudder 350 and shaft 364 respectively. Bushings 365 on shaft 364 sandwich both sides of rudder 350 therebetween. Depressing foot peddles 182, 192(previously described) rotates rudder 350 relative to block 362 causing a biasing tension in spring 368, so releasing the peddles allows the spring 368 to orient rudder 350 back to it's original position.

Figure 10:
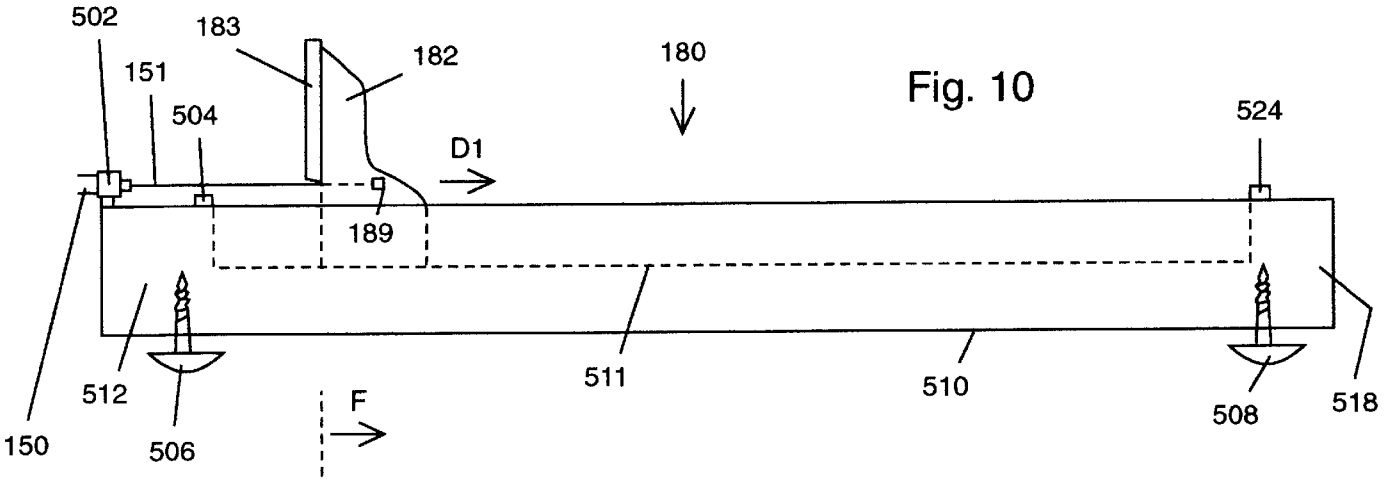
FIG. 10 is an enlarged side view of the foot peddle assembly shown in FIG. 2.
Figure 11:
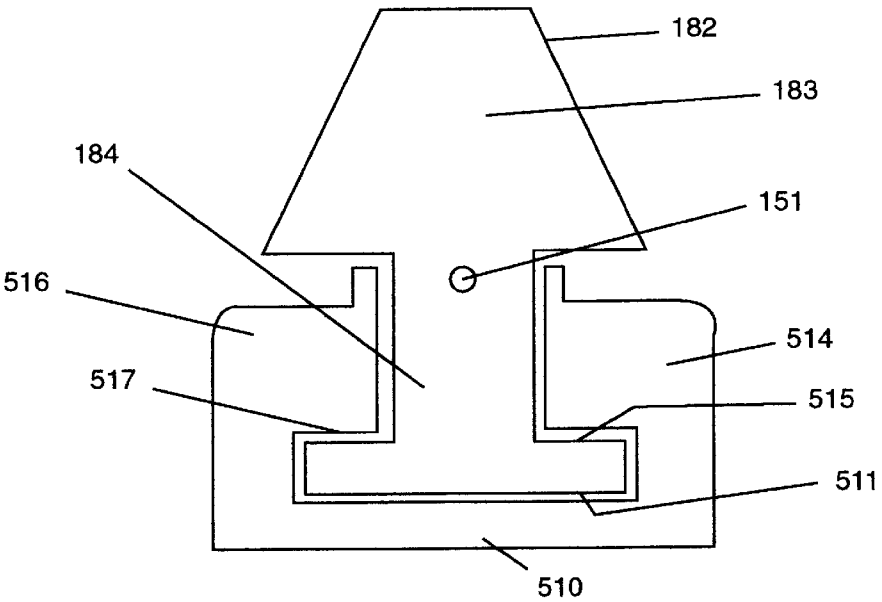
FIG. 11 is a cross-sectional view of the foot peg/peddle of FIG. 10 along arrow F.

FIG. 10 is an enlarged side view of the foot peddle assembly 180 shown in FIG. 2. FIG. 11 is a cross-sectional view of the foot peg 182 of FIG. 10 along arrow F. Referring to FIGS. 10–11, foot peddle assembly 180 includes a rectangular base 510 with closed ends 512, 518, and sides 514, 516 that have a cut-out upside down T-shaped interior surfaces 511, 515, 517 that form a sliding track matching upside down T-shaped base 184 of the foot peg/peddle 182. The foot engaging surface 183 of peg/peddle 182 can be a roughened rubber mat and the like for a better gripping fit When the peg/peddle 182 is moved in the direction of arrow D1, attached cable/wire 151 moves in the same direction out from cable guide 502, from sheathed cable 150. The forward and backward movement of peg/peddle 182 is limited by respective rubber stops 504, 524. Assembly can be mounted to hull 5 by mounting screws 506, 508.

In both embodiments described, cables 130 and 150 can be sheath covered wire cables such as those used on bicycles, and the like. Alternatively, cables 130, 150 can be nylon ropes, cords, and the like. The rudders and peg/peddle assemblies used in the previous embodiments can be fiberglass, injection molded plastic, wood, and the like. Furthermore, the materials used for cable guides and pulleys and the peg/peddle assemblies can be chosen from stainless steel, galvanized metal, hardened plastic, fiberglass, combinations thereof, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A retractable rudder system for small water crafts, comprising in combination:

a water craft that can be propelled by hand manipulated paddles, having a bow and stern;

a first rudder positioned adjacent to the bow of the craft;

a first foot peddle for controlling raising and lowering of the first rudder;

a first cable for connecting the first rudder to the first foot peddle; and a spring means for holding the first rudder in an initial raised position, wherein the user depressing the first foot peddle raises and lowers the first rudder to change direction of the craft.

2. The retractable rudder system of claim 1, wherein the water craft is chosen from at least one of:

a canoe and a kayak.

3. The retractable rudder system of claim 1, further comprising:

a second rudder positioned adjacent to the bow of the craft; and a second foot peddle for controlling raising and lowering of the second rudder, wherein the user depressing the second foot peddle raises and lowers the second rudder to change direction of the craft.

4. The retractable rudder system of claim 3, further comprising:

a second cable for connecting the second rudder to the second foot peddle; and a second spring means for holding the first rudder in an initial raised position, wherein the depressing of the first and the second foot peddles causes the first and second rudders to move to a down lowered position beneath the craft.

5. The retractable rudder system of claim 1, wherein the first rudder includes:

means for mounting the first rudder through a floor portion adjacent to the bow of the craft.

6. The retractable rudder system of claim 3, wherein the first rudder and the second rudder include:

means for mounting the first rudder and the second rudder through a floor portion adjacent to the bow of the craft.

7. The retractable rudder system of claim 5, further comprising:

float means in the bow of the craft for keeping the bow buoyant and afloat.

8. The retractable rudder system of claim 7, wherein the float means includes:

foam.

9. The retractable rudder system of claim 5, further comprising:

a bulk head positioned between the first rudder and the stern of the craft.

10. The retractable rudder system of claim 1, further comprising:

means for mounting the first rudder to an outer side of the craft adjacent to the bow.

11. The retractable rudder system of claim 3, further comprising:

means for mounting the first rudder and the second rudder to opposite outer sides of the craft adjacent to the bow.

12. The retractable rudder system of claim 10, wherein the mounting means includes:

a strap having a first end for attaching to one gunwale side of the craft, and a second end for attaching to a second gunwale side of the craft opposite the first gunwale side.

13. The retractable rudder system of claim 11, wherein the mounting means includes:

a strap having a first end for attaching to one gunwale side of the craft, and a second end for attaching to a second gunwale side of the craft opposite the first gunwale side.

14. The retractable rudder system of claim 10, further comprising:

a first clamp connected to the one end for gripping about the one gunwale side of the craft, a second clamp connected to the second end for gripping about the second gunwale side of the craft.

15. The retractable rudder system of claim 11, further comprising:

a first clamp connected to the one end for gripping about the one gunwale side of the craft, a second clamp connected to the second end for gripping about the second gunwale side of the craft.

16. The retractable rudder system of claim 12, further comprising:

a flexible plate for protecting the strap from a bottom of the water craft.

17. The retractable rudder system of claim 13, further comprising:

a flexible plate for protecting the strap from a bottom of the water craft.

18. A retractable rudder system attachment for small water crafts, comprising in combination:

a water craft that can be propelled by hand manipulated paddles, having a bow and stern;

a first rudder positioned on one side of the craft adjacent to the bow of the craft;

a first housing for supporting the first rudder therein;

a second rudder positioned on a second side of the craft opposite the first side;

a second housing for supporting the second rudder therein;

a strap means for attaching the first housing and the second housing about an outer front portion of the craft; and foot peddles for controlling raising and lowering of the first rudder and the second rudder, wherein individually depressing the foot peddles raises and lowers the first rudder and the second rudder to change forward direction of the craft.

* * * * *